US012330018B2

(12) United States Patent
Aoki

(10) Patent No.: US 12,330,018 B2
(45) Date of Patent: Jun. 17, 2025

(54) EXERCISE SYSTEM WITH LOWER LIMB EXERCISE DEVICE AND CHAIR

(71) Applicant: TOYOTA JIDOSHA KABUSHIKI KAISHA, Toyota (JP)

(72) Inventor: Eisuke Aoki, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 50 days.

(21) Appl. No.: 18/374,011

(22) Filed: Sep. 28, 2023

(65) Prior Publication Data

US 2024/0139580 A1 May 2, 2024

(30) Foreign Application Priority Data

Oct. 31, 2022 (JP) ..... 2022-174321

(51) Int. Cl.
*A63B 22/00* (2006.01)
*A63B 22/06* (2006.01)

(52) U.S. Cl.
CPC ..... *A63B 22/0089* (2013.01); *A63B 22/0694* (2013.01); *A63B 2022/0641* (2013.01)

(58) Field of Classification Search
CPC ..... A63B 22/0089; A63B 22/0694; A63B 2022/0641; A63B 2208/0233; A63B 2225/62; A63B 23/02; A63B 23/04; A63B 23/0216; A63B 22/0605; A63B 23/03516; A63B 23/0482; A63B 2023/006;
(Continued)

(56) References Cited

U.S. PATENT DOCUMENTS 5,728,049 A * 3/1998 Alberts ..... A47C 9/002 601/24
5,769,492 A * 6/1998 Jensen ..... A47C 9/002 297/188.09

(Continued)

FOREIGN PATENT DOCUMENTS

CA 2242952 A1 7/1997
JP H10-94577 A 4/1998

(Continued)

OTHER PUBLICATIONS

Masahiko Fujimara, Mitsutoshi Kawamura, Isao Nara, "Electromyographic study of the influence of a moving seat on the lumbar region fatigue (A trial of chair with slope-decline function)", Journal of health sciences, Hiroshima University, vol. 1(1) 65-72, 2001.

(Continued)

*Primary Examiner* — Nyca T Nguyen
(74) *Attorney, Agent, or Firm* — Dinsmore & Shohl LLP

(57) ABSTRACT

An exercise system includes a rowing exercise device and a chair. The rowing exercise device achieves a lower limb exercise which includes repetitive extension and flexion of at least a knee joint and a hip joint. The chair is the one on which a user who performs the lower limb exercise using the lower limb exercise device sits. The chair includes a seat on which the user sits and a support mechanism capable of supporting the seat in such a manner that the seat can carry out a roll oscillation. The seat carries out a roll oscillation during the lower limb exercise, which causes a motion linkage between a lower limb and a trunk.

8 Claims, 8 Drawing Sheets

(58) Field of Classification Search
CPC ..... A63B 2208/0228; A63B 21/1609; A63B 22/14–18; A47C 9/002
See application file for complete search history.

(56) References Cited

U.S. PATENT DOCUMENTS

| | | | | |
|---|---|---|---|---|
| 6,752,745 | B1 * | 6/2004 | Davis | A63B 21/1609 482/130 |
| 7,922,247 | B2 * | 4/2011 | Dickie | A47C 7/14 297/264.1 |
| 8,435,164 | B2 * | 5/2013 | VanBuren | A63B 26/003 482/145 |
| 8,920,292 | B1 * | 12/2014 | Myers | A63B 21/0055 482/904 |
| 9,533,190 | B2 * | 1/2017 | Walkama | A63B 26/00 |
| 9,788,659 | B1 * | 10/2017 | Jen | A63B 23/0211 |
| 10,376,070 | B1 * | 8/2019 | Jen | A63B 22/18 |
| 2004/0142797 | A1 * | 7/2004 | Andre | A63B 22/0694 482/57 |
| 2005/0029842 | A1 * | 2/2005 | Martin | B62J 1/02 280/220 |
| 2005/0170939 | A1 * | 8/2005 | Lin | A63B 26/003 482/121 |
| 2008/0119333 | A1 * | 5/2008 | Bowser | A63B 21/156 482/62 |
| 2008/0182736 | A1 * | 7/2008 | Burrell | A47C 9/002 482/142 |
| 2009/0197744 | A1 * | 8/2009 | Yamazaki | A63B 21/00181 482/57 |
| 2009/0230743 | A1 * | 9/2009 | Derakhshan | A47C 9/002 297/329 |
| 2009/0261642 | A1 * | 10/2009 | Dickie | A47C 9/002 297/314 |
| 2010/0181815 | A1 * | 7/2010 | Highlander | A47C 3/026 403/53 |
| 2011/0028290 | A1 * | 2/2011 | Ozawa | A63B 26/003 482/142 |
| 2011/0095586 | A1 * | 4/2011 | Fernandez | A47C 3/30 297/344.21 |
| 2011/0105277 | A1 * | 5/2011 | Shauli | A47C 9/002 482/4 |
| 2011/0140484 | A1 * | 6/2011 | Chang | A63B 21/1609 601/134 |
| 2011/0294633 | A1 * | 12/2011 | Esrick | A63B 21/0552 482/139 |
| 2012/0077653 | A1 * | 3/2012 | Dedov | A63B 21/4047 482/139 |
| 2012/0292968 | A1 * | 11/2012 | Lee | A47C 7/441 297/313 |
| 2013/0331243 | A1 * | 12/2013 | Walkama | A47C 9/002 482/130 |
| 2014/0132051 | A1 * | 5/2014 | Freedman | A47C 7/02 297/312 |
| 2014/0287883 | A1 * | 9/2014 | Decca | A63B 22/0694 482/57 |
| 2015/0306449 | A1 * | 10/2015 | Harada | A47C 7/62 482/131 |
| 2017/0290432 | A1 * | 10/2017 | Reinhard | A47C 7/025 |
| 2018/0289167 | A1 * | 10/2018 | Tedesco | A47C 3/026 |
| 2018/0339190 | A1 * | 11/2018 | Bailar | A63B 22/0046 |
| 2019/0232106 | A1 * | 8/2019 | Dalmia | A63B 22/0046 |
| 2020/0289882 | A1 * | 9/2020 | Pena | A63B 21/1609 |
| 2022/0408927 | A1 | 12/2022 | Aoki et al. | |

FOREIGN PATENT DOCUMENTS

| | | | |
|---|---|---|---|
| JP | 2016-010669 | A | 1/2016 |
| JP | 2018-126281 | A | 8/2018 |
| JP | 2023-005484 | A | 1/2023 |
| JP | 2024-068378 | A | 5/2024 |
| WO | 97/025107 | A1 | 7/1997 |

OTHER PUBLICATIONS

Tatsuya Murase, Yosimasa Sakai, Masao Sugi, University of Electro Communications, "An evaluation of system which improve fatigues of lumbar muscle, with the chair; can move the seat as till", 2013 The Japan Society of Precision Engineering Spring Conference. 2013.

* cited by examiner

BELLOWS-TYPE BALLOON

COIL SPRING

EXERCISE SYSTEM WITH LOWER LIMB EXERCISE DEVICE AND CHAIR

CROSS REFERENCE TO RELATED APPLICATIONS

This application is based upon and claims the benefit of priority from Japanese patent application No. 2022-174321, filed on Oct. 31, 2022, the disclosure of which is incorporated herein in its entirety by reference.

BACKGROUND

The present disclosure relates to an exercise system that achieves a motion linkage between lower limbs and a trunk.

Patent Literature 1 (Japanese Unexamined Patent Application Publication No. H10-94577) discloses an exercise device in which a user pushes pedals while being in a sitting position.

SUMMARY

When a rowing exercise is performed while a user is in a sitting position in the configuration disclosed in Patent Literature 1, it is required for the user to perform training of not only his/her lower limbs but also a trunk thereof. With the configuration disclosed in Patent Literature 1, however, it is impossible for the user to perform training of his/her lower limbs and a trunk at the same time.

An object of the present disclosure is to provide a technique for achieving a motion linkage between lower limbs and a trunk when a user who is in a sitting posture performs a lower limb exercise.

According to a first aspect of the present disclosure, an exercise system including: a lower limb exercise device configured to achieve a lower limb exercise which includes repetitive extension and flexion of at least a knee joint and a hip joint; and a chair on which a user who performs the lower limb exercise using the lower limb exercise device sits, in which the chair includes: a seat on which the user sits; and a support mechanism capable of supporting the seat in such a manner that the seat can carry out a roll oscillation, and the seat carries out a roll oscillation during the lower limb exercise, which causes a motion linkage between a lower limb and a trunk, is provided. According to the aforementioned configuration, it is possible to achieve a motion linkage between a lower limb and a trunk when a user who is in a sitting posture performs a lower limb exercise.

According to a second aspect of the present disclosure, an exercise system including: a lower limb exercise device configured to achieve a lower limb exercise which includes repetitive extension and flexion of at least a knee joint and a hip joint; and an exercise assisting tool that can be mounted on a seating surface of a chair and on which a user who performs the lower limb exercise using the lower limb exercise device sits, in which the exercise assisting tool includes: a seat on which the user sits; and a support mechanism capable of supporting the seat in such a manner that the seat can carry out a roll oscillation, and the seat carries out a roll oscillation during the lower limb exercise, which causes a motion linkage between a lower limb and a trunk is provided. According to the aforementioned configuration, it is possible to achieve a motion linkage between a lower limb and a trunk when a user who is in a sitting posture performs a lower limb exercise.

The support mechanism may include a right-leg-side elastic body that is disposed under the seat and corresponds to a right-leg-side ischium, which is an ischium on a right leg side of the user who sits on the seat; and a left-leg-side elastic body that is disposed under the seat and corresponds to a left-leg-side ischium, which is an ischium on a left leg side of the user who sits on the seat. According to the aforementioned configuration, the support mechanism may be provided with a simple configuration.

Each of the right-leg-side elastic body and the left-leg-side elastic body may be a bag body in which gas is enclosed. According to the aforementioned configuration, an inexpensive exercise system may be provided.

The bag body may have a hemispherical shape that is convex downward in a state in which the gas is enclosed therein. According to the aforementioned configuration, effective roll oscillation may be carried out.

Each of the right-leg-side elastic body and the left-leg-side elastic body may be a coil spring. According to the aforementioned configuration, it is possible to provide inexpensive right-leg-side elastic body and left-leg-side elastic body.

The support mechanism may further correct a pitch posture of the pelvis of the user. According to the aforementioned configuration, the aforementioned motion linkage is efficiently generated.

The support mechanism may further include a coccyx elastic body that is disposed under the seat and corresponds to a coccyx of the user who sits on the seat, and a pitch posture of the pelvis of the user may be corrected by the coccyx elastic body. According to the aforementioned configuration, the support mechanism may be provided with a simple configuration.

The coccyx elastic body may be a bag body in which gas is enclosed, or a coil spring. According to the aforementioned configuration, it is possible to provide an inexpensive coccyx elastic body.

According to the present disclosure, it is possible to provide a motion linkage between a lower limb and a trunk when a user who is in a sitting posture performs a lower limb exercise.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

First Embodiment

Hereinafter, with reference to FIGS. 1 to 4, a first embodiment of the present disclosure will be described.

Figure 1:
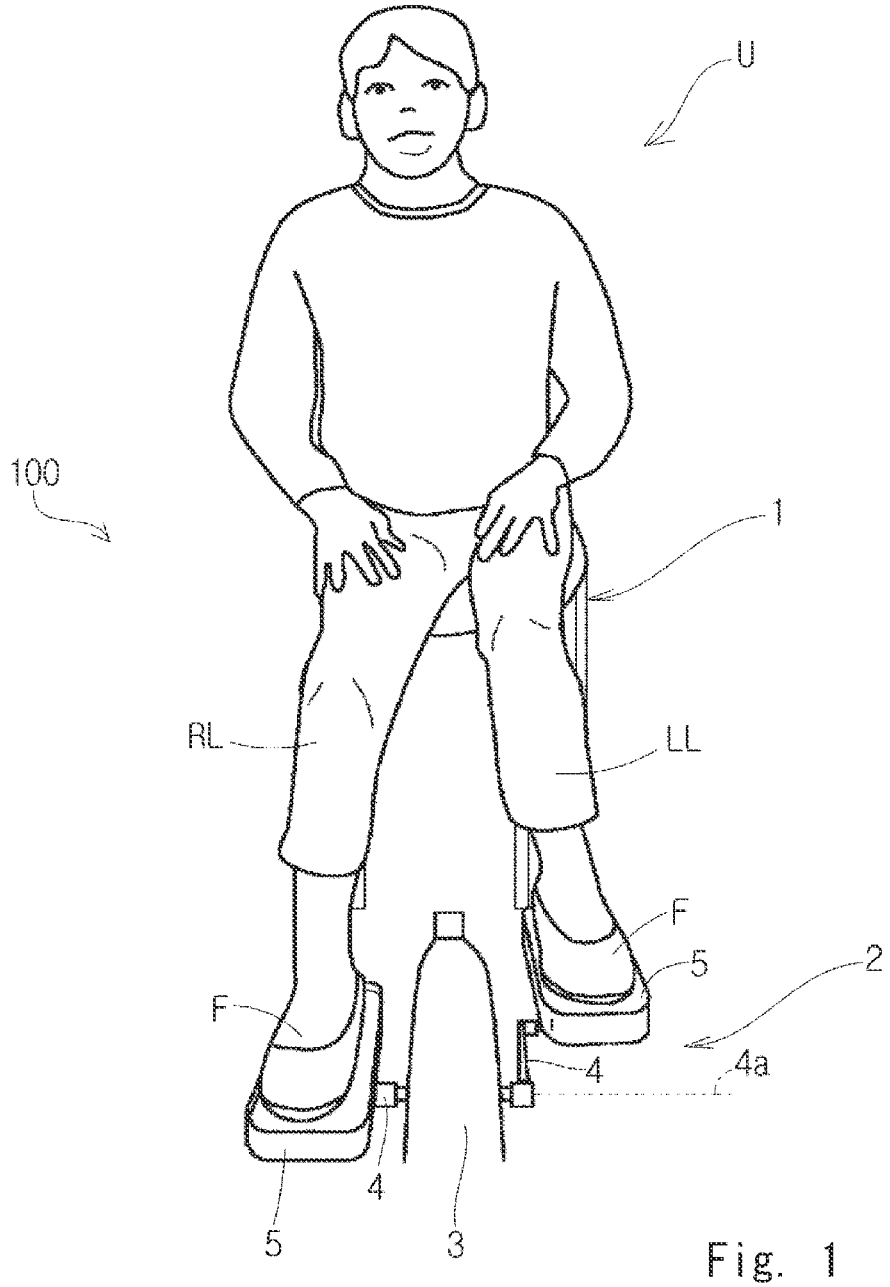
FIG. 1 is a diagram showing a state in which a user who is sitting performs a lower limb exercise using a rowing exercise device (first embodiment)

FIG. 1 shows an exercise system 100. As shown in FIG. 1, a user U performs a lower limb exercise using a rowing exercise device 2 in a state in which the user U is sitting on a chair 1.

The rowing exercise device 2 is one specific example of a lower limb exercise device that achieves a lower limb exercise including repetitive extension and flexion of knee joints, hip joints, and ankle joints. The rowing exercise device 2 includes a device body 3, a pair of cranks 4, and a pair of pedals 5. The pair of pedals 5 are provided in the pair of respective cranks 4 in such a way that the pedals 5 can carry out a pitch turn. The pair of cranks 4 are provided in such a way that they can carry out a pitch turn by the device body 3. The user U performs a rowing exercise by putting his/her feet F on the pair of respective pedals 5 in a state in which he/she is sitting on the chair 1 and alternately stepping with his/her right leg RL and left leg LL. At this time, extension and flexion of the knee joints, the hip joints, and the ankle joints of the right leg RL and the left leg LL are repeated. In general, when the knee joint of the right leg RL is extended, the knee joint of the left leg LL is flexed. When the hip joint of the right leg RL is extended, the hip joint of the left leg LL is flexed. When the ankle joint of the right leg RL is extended, the ankle joint of the left leg LL is flexed. Accordingly, the pair of pedals 5 are rotated about a crank shaft 4*a* in phases opposite to each other. That is, the rowing exercise device 2 achieves a lower limb exercise in which both feet F draw a circular trajectory about the crank shaft 4*a*.

Note that the rowing exercise device 2 is merely one example of a lower limb exercise device. That is, the lower limb exercise device is not limited to the rowing exercise device 2. The lower limb exercise device may be the one that achieves a lower limb exercise in which the user U who is sitting on the chair 1 moves his/her both feet F back and forth in parallel to the floor surface.

Figure 2:
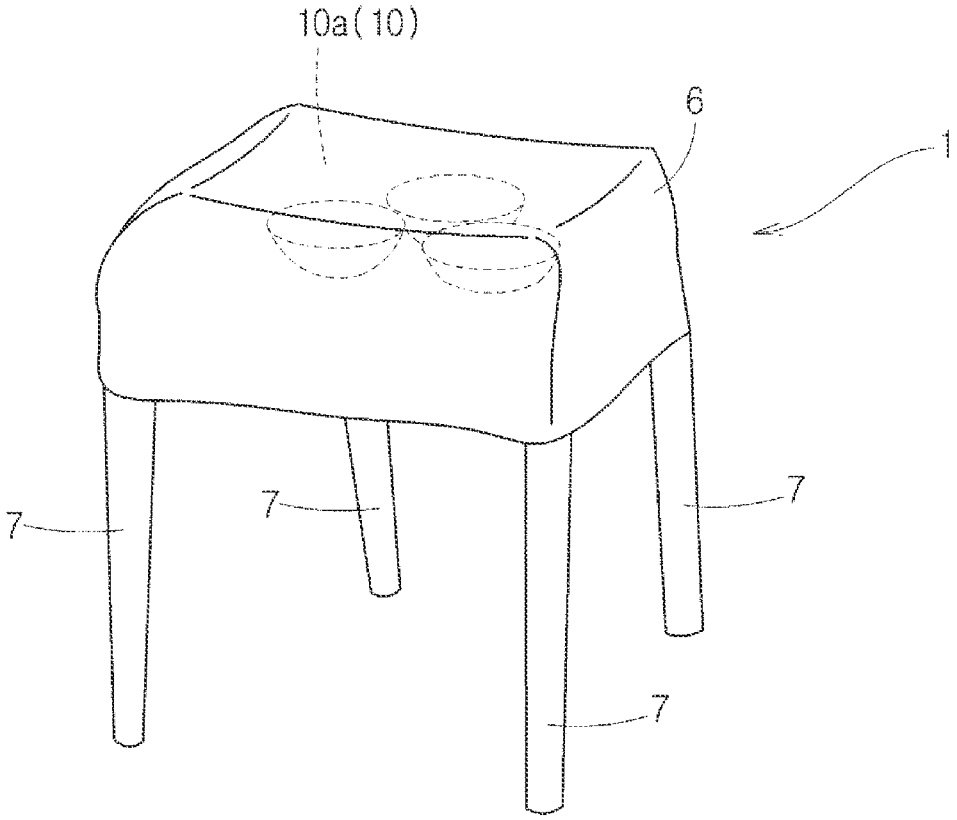
FIG. 2 is a perspective view of a chair (first embodiment)

FIG. 2 shows a perspective view of the chair 1. As shown in FIG. 2, the chair 1 includes a main body 6 of the chair and a plurality of legs 7. The main body 6 of the chair is supported by the plurality of legs 7.

Figure 3:
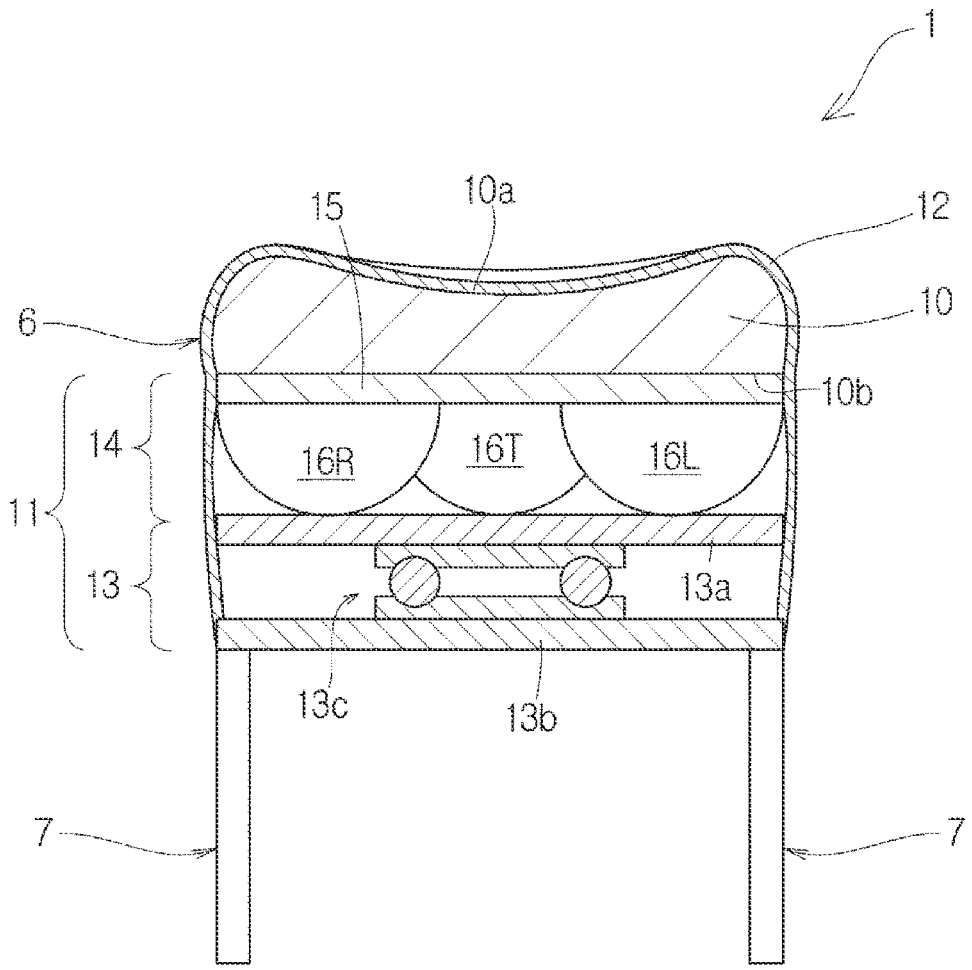
FIG. 3 is a front cross-sectional view of the chair (first embodiment)

FIG. 3 shows a front cross-sectional view of the chair 1. As shown in FIG. 3, the main body 6 of the chair includes a seat 10, a support mechanism 11 that supports the seat 10, and a cover 12. The support mechanism 11 is disposed under (inferior to) the seat 10. That is, the seat 10 is disposed above (superior to) the support mechanism 11.

The seat 10 is a part on which the user U sits. The seat 10 includes a seating surface 10*a* that faces upward and a lower surface 10*b* that faces downward. As shown in FIGS. 2 and 3, the seating surface 10*a* is slightly tilted in such a way that it is elevated toward the back (posterior). The seat 10 is formed of a soft material that is suitable for distributing the pressure between the user U when the user U sits thereon and the seat 10. In general, the seat 10 is an open cell foam (continuous air bubble structure) such as urethane foam or a closed cell foam (independent air bubble structure) such as polyethylene foam or rubber sponge.

A concave part for positioning the pelvis of the user U who sits on the seat relative to the seat 10 may be formed in the seat 10. In general, the concave part is formed so as to accommodate the hip, the right thigh, and the left thigh of the user. Alternatively, a line for indicating the position of the hip of the user U who sits on the seat 10 may be drawn in the seat 10. Accordingly, it is possible to achieve a desirable positional relation between the seat 10 and the pelvis of the user U.

The support mechanism 11 is a mechanism that supports the seat 10 in such a manner that the seat 10 can carry out a roll oscillation and a yaw oscillation. The support mechanism 11 includes a yaw oscillation mechanism 13 and a roll oscillation mechanism 14. The roll oscillation mechanism 14 is disposed over the yaw oscillation mechanism 13. Alternatively, the roll oscillation mechanism 14 may be disposed under the yaw oscillation mechanism 13. Alternatively, the yaw oscillation mechanism 13 may be omitted.

The yaw oscillation mechanism 13 includes an upper support plate 13*a* disposed in an upper part of the yaw oscillation mechanism 13, a lower support plate 13*b* disposed in a lower part of the yaw oscillation mechanism 13, and a bearing 13*c* disposed between the upper support plate 13*a* and the lower support plate 13*b*. That is, the upper support plate 13*a* is disposed over the bearing 13*c* and the lower support plate 13*b* is disposed under the bearing 13*c*. The plurality of legs 7 are fixed to the lower support plate 13*b* in such a way that these legs 7 are protruded downward from the lower support plate 13*b*. The upper support plate 13*a* is able to carry out a yaw oscillation relative to the lower support plate 13*b* by the bearing 13*c*. In this embodiment, the bearing 13*c* is a rolling bearing. Alternatively, the bearing 13*c* may be a sliding bearing. The upper support plate 13*a* and the lower support plate 13*b*, which are plates having a sufficiently high rigidity so that they do not easily bend under a load such as the one applied by the user U, are made of, for example, wood, metal, or resin.

The roll oscillation mechanism 14 includes an upper support plate 15 disposed in an upper part of the roll oscillation mechanism 14 and a plurality of balloons 16R, 16T, and 16L, collectively referred to as balloons 16, disposed in a lower part of the roll oscillation mechanism 14. That is, the upper support plate is disposed over the plurality of balloons 16. The plurality of balloons 16 are disposed under the upper support plate 15. The upper support plate 15, which is a plate having a sufficiently high rigidity so that it does not easily bend under a load such as the one applied by the user U, is made of, for example, wood, metal, or resin. The upper support plate 15 is disposed on the lower surface 10*b* of the seat 10, whereby it is possible to prevent the seat 10 from being curved so as to be convex downward when the user U sits on the seat 10.

Each balloon 16 is one specific example of an elastic body that may generate a repulsive force upward when it is compressed in the vertical direction. Each balloon 16 is one specific example of a bag body in which gas is enclosed. That is, each balloon 16 is swollen as gas is enclosed therein under a predetermined pressure and thus exhibits a predetermined shape. In this embodiment, each balloon 16 has a hemispherical shape that is convex downward in a state in which the gas is enclosed therein. In general, each balloon 16 is made of vinyl chloride resin.

The plurality of balloons 16 include a right ischium balloon 16R, a left ischium balloon 16L, and a coccyx balloon 16T. The right ischium balloon 16R, which is disposed under the seat 10, is one specific example of a right-leg-side elastic body that corresponds to a right-leg-side ischium, which is the ischium on the right leg side of the user U who sits on the seat 10. The left ischium balloon 16L, which is disposed under the seat 10, is one specific example of a right-leg-side elastic body that corresponds to a left-leg-side ischium, which is the ischium on the left leg side of the user U who sits on the seat 10. The coccyx balloon 16T, which is disposed under the seat 10, is one specific example of a coccyx elastic body that corresponds to the coccyx of the user U who sits on the seat 10.

Figure 4:
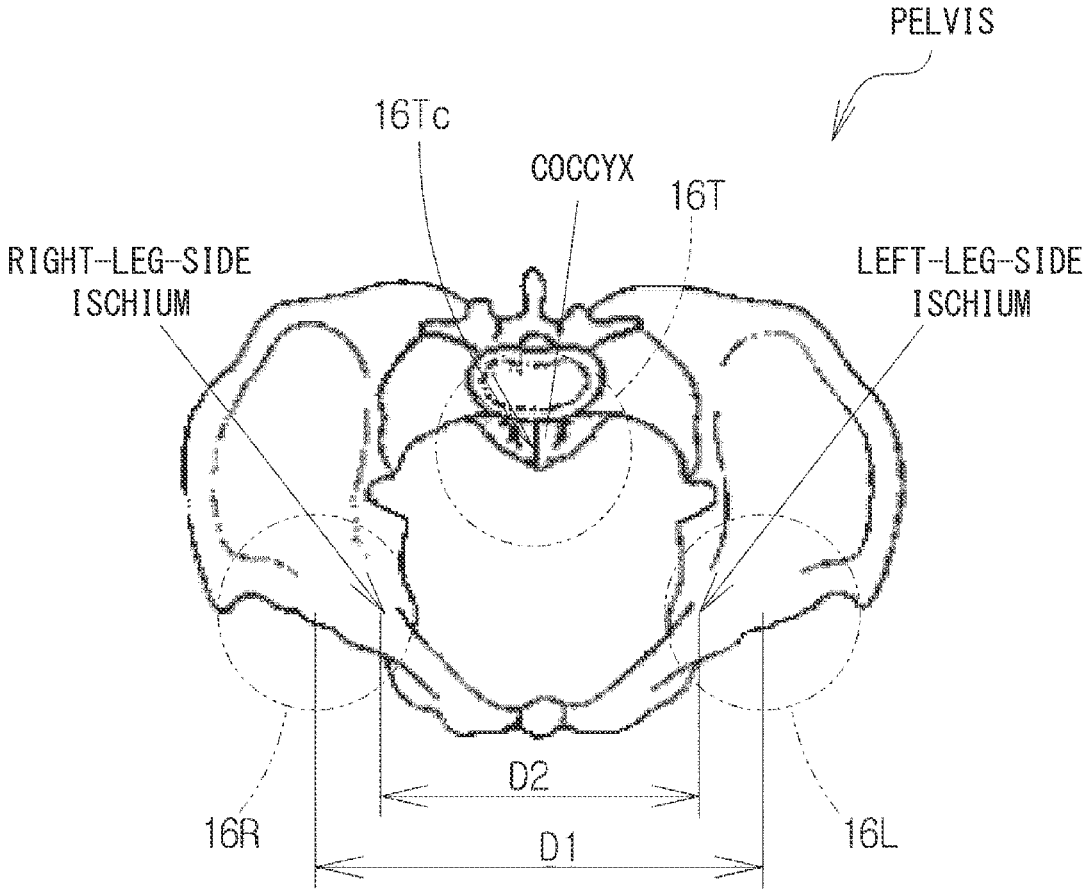
FIG. 4 is a plan view of a pelvis (first embodiment)

FIG. 4 shows a plan view of the pelvis of the user U when the user U sits on the seat 10. The right ischium balloon 16R is disposed so as to correspond to the right-leg-side ischium of the user U who sits on the seat 10. The left ischium balloon 16L is disposed so as to correspond to the left-leg-side ischium of the user U who sits on the seat 10. The coccyx balloon 16T is disposed so as to correspond to the coccyx of the user U who sits on the seat 10.

Further specifically, in the plan view shown in FIG. 4, a distance D1 between the center of the right ischium balloon 16R and the center of the left ischium balloon 16L is larger than a distance D2 between the lower end of the right-leg-side ischium and the lower end of the left-leg-side ischium. That is, in the plan view shown in FIG. 4, the right ischium balloon 16R is disposed slightly outside (lateral) of the lower end of the right-leg-side ischium. Likewise, the left ischium balloon 16L is disposed slightly outside of the lower end of the left-leg-side ischium. With this arrangement, a repulsive force of the right ischium balloon 16R when the pelvis rolls to the right side efficiently pushes back the pelvis so that the pelvis rolls to the left side. Likewise, a repulsive force of the left ischium balloon 16L when the pelvis rolls to the left side efficiently pushes back the pelvis so that the pelvis rolls to the right side. Accordingly, it is possible to rhythmically roll the pelvis alternately to the right and the left with a small load for the user U. Alternatively, the right ischium balloon 16R may be disposed immediately below the lower end of the right-leg-side ischium and the left ischium balloon 16L may be provided immediately below the lower end of the left-leg-side ischium.

As described above, by providing the right ischium balloon 16R and the left ischium balloon 16L, when the user U sits on the seat 10 and performs a rowing exercise using the rowing exercise device 2, the pelvis of the user U carries out a roll turn to the right and left, whereby an ascending motion linkage from the lower limb to the trunk will occur and it is possible for the user U to perform training of not only his/her lower limbs but also the trunk thereof. That is, the exercise of the trunk muscles represented by the rectus abdominis, transversus abdominis, and erector spinae will be achieved simultaneously.

On the other hand, as shown in FIG. 4, the coccyx balloon 16T is disposed immediately below the lower end of the coccyx. That is, a center 16Tc of the coccyx balloon 16T is positioned immediately below the lower end of the coccyx. Alternatively, the center 16Tc of the coccyx balloon 16T may be positioned anterior to the lower end of the coccyx or may be disposed posterior to the lower end of the coccyx in a plan view shown in FIG. 4. In short, it is sufficient that the coccyx balloon 16T be disposed posterior to the right ischium balloon 16R and the left ischium balloon 16L. According to the aforementioned configuration, the coccyx balloon 16T is able to support the seat 10 so that the pitch posture of the seat 10 is made stable.

In order to efficiently generate an ascending motion linkage from the lower limb to the trunk, it is important that the pitch posture of the pelvis be slightly tilted forward. There may be various methods for correcting the pitch posture of the pelvis. The first method is, for example, to make the internal pressure of the coccyx balloon 16T higher than the internal pressure of the right ischium balloon 16R and that of the left ischium balloon 16L. According to the aforementioned configuration, when the user U sits on the seat 10, the front part of the seat 10 sinks and the back part of the seat 10 hardly sinks, whereby the pitch posture can be corrected. The second method is to form the seat 10 in such a way that the seating surface 10*a* of the seat 10 rises toward the back, as shown in FIG. 2. According to the aforementioned configuration, the seating surface 10*a* itself rises toward the back, whereby the pitch posture can be corrected. The first method and the second method may be combined with each other.

Referring once again to FIG. 3, the cover 12, which covers the seat 10 and the support mechanism 11, is generally made of cloth.

The first embodiment has been described above. The first embodiment has the following features.

The exercise system 100 shown in FIG. 1 includes the rowing exercise device 2 (lower limb exercise device) and the chair 1. The rowing exercise device 2 achieves a lower limb exercise which includes repetitive extension and flexion of at least knee joints and hip joints. The chair 1 is the one on which the user U who performs the lower limb exercise using the rowing exercise device 2 sits. As shown in FIG. 3, the chair 1 includes the seat 10 on which the user U sits and the support mechanism 11 that supports the seat 10 in such a manner that the seat 10 can carry out a roll oscillation. Since the seat 10 carries out a roll oscillation during the lower limb exercise, a motion linkage between lower limbs and the trunk occurs. According to the aforementioned configuration, it is possible to achieve a motion linkage between lower limbs and the trunk when a user who is in a sitting posture performs a lower limb exercise.

As shown in FIGS. 3 and 4, the support mechanism 11 includes the right ischium balloon 16R (right-leg-side elastic body) that is disposed under the seat 10 and corresponds to a right-leg-side ischium, which is the ischium on the right leg side of the user U who sits on the seat 10, and the left ischium balloon 16L (left-leg-side elastic body) that is disposed under the seat 10 and corresponds to a left-leg-side ischium, which is the ischium on the left leg side of the user U who sits on the seat 10. According to the aforementioned configuration, the support mechanism 11 may be provided with a simple configuration.

Further, the right ischium balloon 16R and the left ischium balloon 16L are bag bodies in which gas is enclosed. According to the aforementioned configuration, an inexpensive exercise system 100 may be provided.

Further, as shown in FIG. 3, the right ischium balloon 16R and the left ischium balloon 16L have a hemispherical shape that is convex downward in a state in which gas is enclosed therein. According to the aforementioned configuration, an effective roll oscillation may be carried out.

The support mechanism 11 further corrects the pitch posture of the pelvis of the user U. According to the aforementioned configuration, it is possible to efficiently occur an ascending motion linkage from the lower limbs to the trunk.

Further, as shown in FIG. 3, the support mechanism 11 is disposed under the seat 10 and further includes the coccyx balloon 16T as a coccyx elastic body that corresponds to the coccyx of the user U who sits on the seat 10. The pitch posture of the pelvis of the user U is corrected by the coccyx balloon 16T. According to the aforementioned configuration, the support mechanism 11 may be provided with a simple configuration.

Further, the coccyx balloon 16T, which is a coccyx elastic body, is a bag body in which gas is enclosed. According to the aforementioned configuration, it is possible to provide an inexpensive coccyx elastic body.

Second Embodiment

Figure 5:
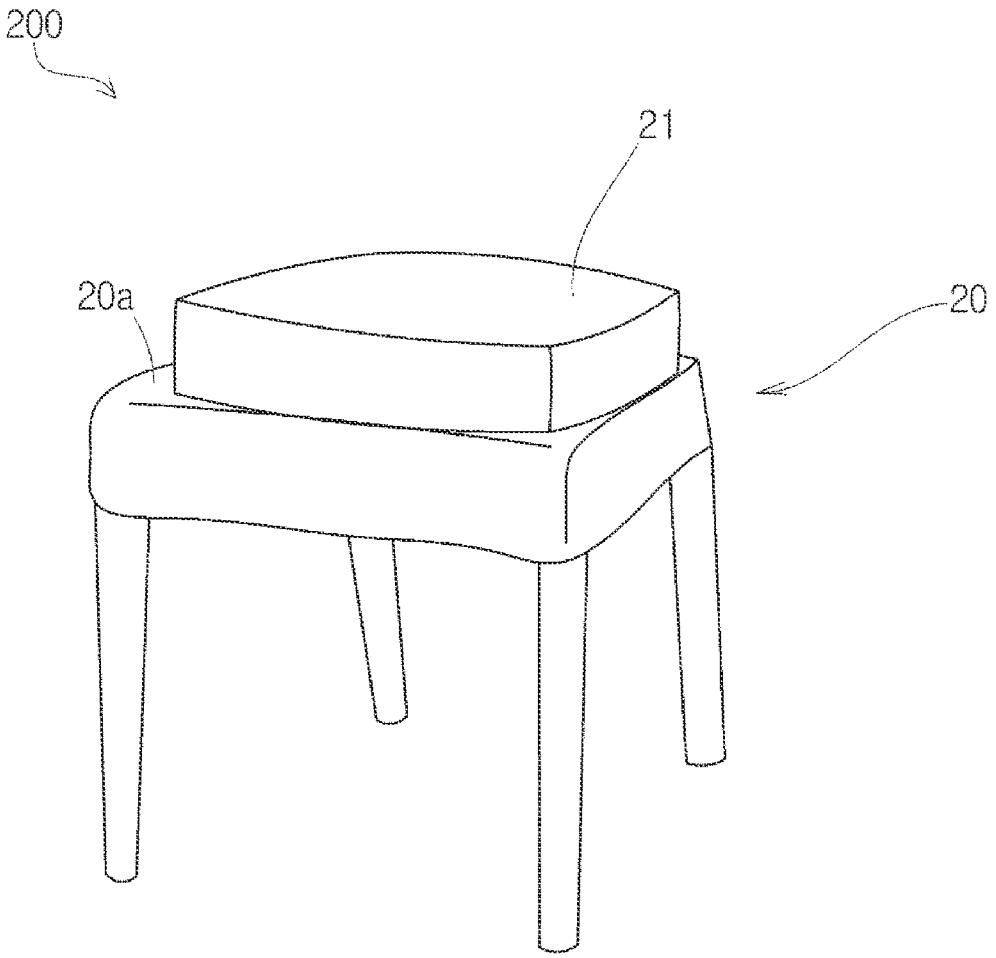
FIG. 5 is a perspective view of a chair (second embodiment)
Figure 6:
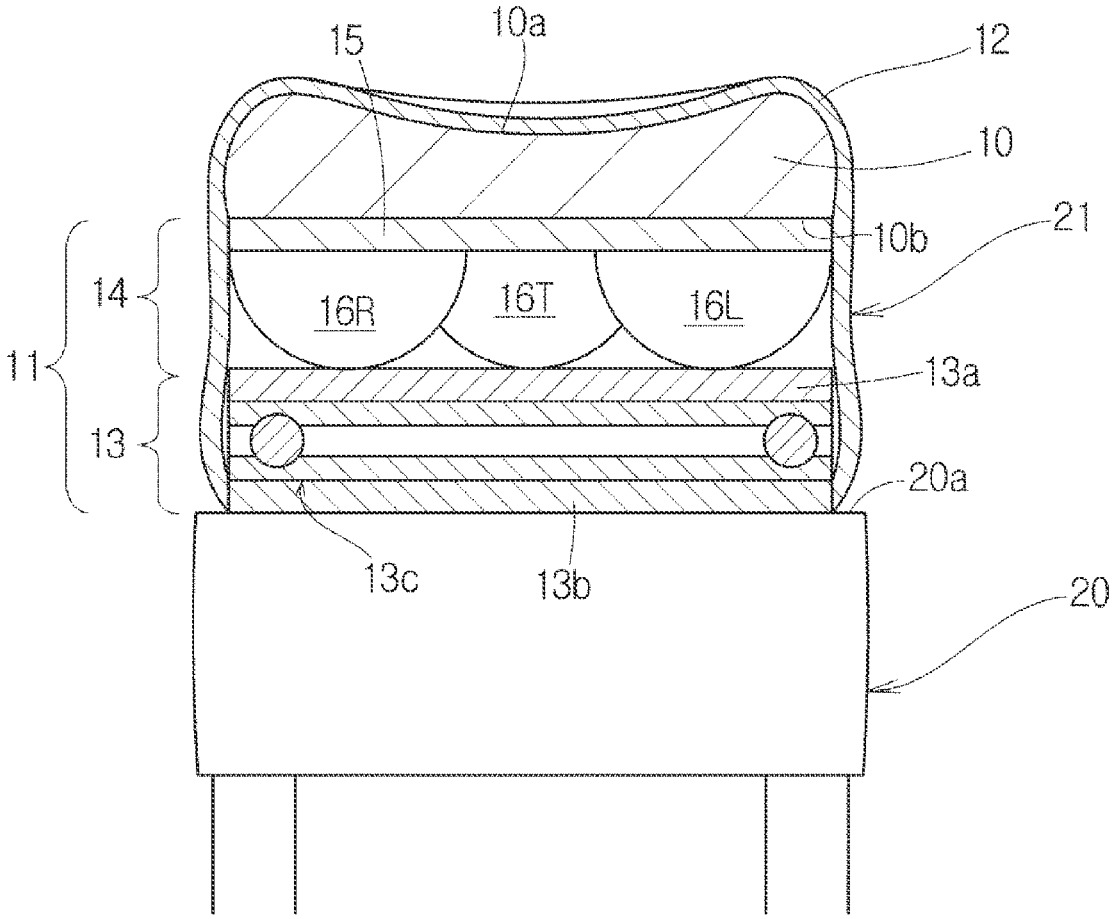
FIG. 6 is a front cross-sectional view of the chair (second embodiment)

Referring next to FIGS. 5 and 6, a second embodiment will be described. Hereinafter, differences between this embodiment and the first embodiment will be mainly described, and redundant descriptions will be omitted.

As shown in FIG. 3, in the aforementioned first embodiment, the chair 1 itself includes the seat 10 and the support mechanism 11.

On the other hand, in this embodiment, as shown in FIGS. 5 and 6, an exercise assisting tool 21 that can be applied to an existing chair 20 includes a seat and a support mechanism 11.

That is, the exercise assisting tool 21 is mounted on a seating surface 20*a* of the chair 20 for use. Specifically, as shown in FIG. 6, the exercise assisting tool 21 is mounted on the seating surface 20*a* of the chair 20 in such a way that a lower support plate 13*b* of a yaw oscillation mechanism 13 of the support mechanism 11 included in the exercise assisting tool 21 is opposed to the seating surface 20*a* of the chair 20 in the vertical direction.

In short, the above-described second embodiment includes the following features.

As shown in FIG. 5, the exercise system 200 includes a rowing exercise device (not shown), and the exercise assisting tool 21 that can be mounted on the seating surface 20*a* of the chair 20 and on which the user U who performs a lower limb exercise using the rowing exercise device 2 sits. The exercise assisting tool 21 includes the seat 10 on which the user U sits and the support mechanism 11 that supports the seat 10 in such a manner that the seat 10 can carry out a roll oscillation. Since the seat 10 carries out a roll oscillation during the lower limb exercise, a motion linkage between lower limbs and a trunk occurs. According to the aforementioned configuration, it is possible to achieve a motion linkage between lower limbs and a trunk when a user who is in a sitting posture performs a lower limb exercise.

While the first and second embodiments of the present disclosure have been described above, each of the above embodiments may be changed as follows.

Figure 7:
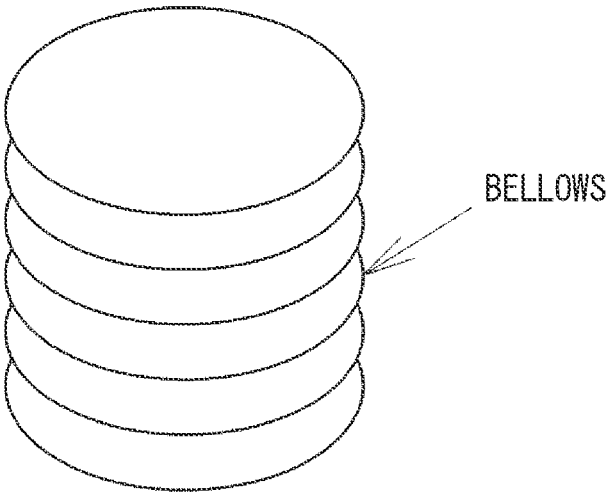
FIG. 7 is a front view of a bellows-type balloon (modified example)
Figure 8:
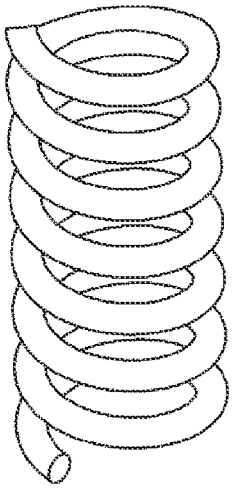
FIG. 8 is a front view of a coil spring (modified example).

That is, as shown in FIGS. 3 and 6, in each of the above embodiments, each balloon 16 has a hemispherical shape that is convex downward in a state in which gas is enclosed therein. Alternatively, as shown in FIG. 7, each balloon 16 may be a bellows-type balloon having bellows in an outer peripheral part in such a way that it can be extended and retracted in the longitudinal direction. In this case, each balloon 16 may be disposed in such a way that its longitudinal direction is the vertical direction. Further, instead of each balloon 16, a coil spring may be employed, as shown in FIG. 8. In this case, the coil spring may be disposed in such a way that its longitudinal direction is the vertical direction. The coil spring that is disposed instead of the right ischium balloon 16R may be disposed obliquely in such a way that it is elevated toward the inside (medial) when the chair 1 or the exercise assisting tool 21 is seen in a front view. In this case, a repulsive force of the coil spring that occurs when the pelvis carries out a roll turn acts slightly inward, whereby it becomes possible to effectively return the pelvis that has carried out a roll turn to the neutral state. The same goes for a coil spring that is disposed instead of the left ischium balloon 16L. Further, instead of each balloon 16, another elastic body such as rubber may be employed.

Further, the right ischium balloon 16R, the left ischium balloon 16L, and the coccyx balloon 16T may be integrally formed instead of being formed as separate bodies. In some embodiments, however, the internal spaces of the right ischium balloon 16R, the left ischium balloon 16L, and the coccyx balloon 16T are separated from one another. This is because, if they are not separated from one another, the right ischium balloon 16R and the left ischium balloon 16L will not likely to generate repulsive forces when the pelvis carries out a roll turn.

Further, the support mechanism 11 may include a plurality of coccyx balloons 16T. In this case, these plurality of coccyx balloons 16T are disposed posterior to the right ischium balloon 16R and the left ischium balloon 16L.

Further, in each embodiment, the yaw oscillation mechanism 13 may be omitted. When, in particular, the chair 20 itself supports the seating surface 20*a* in such a way that the seating surface 20*a* can carry out a yaw turn in the second embodiment, the yaw oscillation mechanism 13 included in the exercise assisting tool 21 may be omitted.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. An exercise system comprising:

a lower limb exercise device configured to achieve a lower limb exercise which includes repetitive extension and flexion of at least a knee joint and a hip joint; and a chair on which a user who performs the lower limb exercise using the lower limb exercise device sits, wherein the chair comprises:

a seat on which the user sits; and a support mechanism configured to support the seat in such a manner that the seat is configured to carry out a roll oscillation, the seat carries out the roll oscillation during the lower limb exercise, which causes a motion linkage between a lower limb and a trunk, the support mechanism comprises:

a right-leg-side elastic body that is disposed under the seat and the right-leg-side elastic body is configured to correspond to a right-leg-side ischium, which is an ischium on a right leg side of the user who sits on the seat; and a left-leg-side elastic body that is disposed under the seat and the left-leg-side elastic body is configured to correspond to a left-leg-side ischium, which is an ischium on a left leg side of the user who sits on the seat, each of the right-leg-side elastic body and the left-leg-side elastic body is a bag body in which gas is enclosed, and the bag body has a hemispherical shape that is convex downward in a state in which the gas is enclosed therein and has a flat top facing the seat.

2. The exercise system according to claim 1, wherein the support mechanism is configured to correct a pitch posture of the pelvis of the user.

3. The exercise system according to claim 2, wherein the support mechanism further comprises a coccyx elastic body that is disposed under the seat and the coccyx elastic body is configured to correspond to a coccyx of the user who sits on the seat, and the coccyx elastic body is configured to correct the pitch posture of the pelvis of the user.

4. The exercise system according to claim 3, wherein the coccyx elastic body is a bag body in which gas is enclosed, or a coil spring.

5. An exercise system comprising:

a lower limb exercise device configured to achieve a lower limb exercise which includes repetitive extension and flexion of at least a knee joint and a hip joint; and an exercise assisting tool that can be mounted on a seating surface of a chair and on which a user who performs the lower limb exercise using the lower limb exercise device sits, wherein the exercise assisting tool comprises:

a seat on which the user sits; and a support mechanism configured to support the seat in such a manner that the seat is configured to carry out a roll oscillation, and the seat carries out the roll oscillation during the lower limb exercise, which causes a motion linkage between a lower limb and a trunk, the support mechanism comprises:

a right-leg-side elastic body that is disposed under the seat and the right-leg-side elastic body is configured to correspond to a right-leg-side ischium, which is an ischium on a right leg side of the user who sits on the seat; and a left-leg-side elastic body that is disposed under the seat and the left-leg-side elastic body is configured to correspond to a left-leg-side ischium, which is an ischium on a left leg side of the user who sits on the seat, each of the right-leg-side elastic body and the left-leg-side elastic body is a bag body in which gas is enclosed, and the bag body has a hemispherical shape that is convex downward in a state in which the gas is enclosed therein and has a flat top facing the seat.

6. The exercise system according to claim 5, wherein the support mechanism is configured to correct a pitch posture of the pelvis of the user.

7. The exercise system according to claim 6, wherein the support mechanism further comprises a coccyx elastic body that is disposed under the seat and the coccyx elastic body is configured to correspond to a coccyx of the user who sits on the seat, and the coccyx elastic body is configured to correct the pitch posture of the pelvis of the user.

8. The exercise system according to claim 7, wherein the coccyx elastic body is a bag body in which gas is enclosed, or a coil spring.

* * * * *